United States Patent [19]

Spiller

[11] 4,190,527

[45] Feb. 26, 1980

[54] INTERLOCKING SCREEN ELEMENTS

[76] Inventor: Clifford M. Spiller, The Smithy, Burghwallis, Doncaster, England

[21] Appl. No.: 850,104

[22] Filed: Nov. 9, 1977

[30] Foreign Application Priority Data

Nov. 10, 1976 [GB] United Kingdom ..... 46687/76

[51] Int. Cl.[2] ..... B07B 1/46

[52] U.S. Cl. ..... 209/363; 209/392; 209/313

[58] Field of Search ..... 209/307, 392, 397, 399, 209/233, 363, 364, 311, 313; 52/438; 160/229, 231; 29/526

[56] References Cited

U.S. PATENT DOCUMENTS

| | | | |
|---|---|---|---|
| 550,630 | 12/1895 | Lugrin | 160/229 R |
| 673,580 | 5/1901 | Lustig | 160/231 R |
| 1,174,539 | 3/1916 | Bauer | 100/229 R |
| 1,393,966 | 10/1921 | Richman | 52/438 |
| 2,210,940 | 8/1940 | Leemhuis | 52/438 X |
| 2,244,042 | 6/1941 | Burlow | 160/229 R |
| 2,893,484 | 7/1959 | Gordon | 160/229 R |
| 3,833,998 | 9/1974 | Tomlinson | 29/526 X |
| 3,943,054 | 3/1976 | Simonson | 209/392 |
| 4,062,769 | 12/1977 | Simonson | 209/399 |

FOREIGN PATENT DOCUMENTS

| | | | |
|---|---|---|---|
| 485365 | 12/1927 | Fed. Rep. of Germany | 209/307 |
| 1251635 | 10/1967 | Fed. Rep. of Germany | 209/392 |
| 2108854 | 8/1972 | Fed. Rep. of Germany | 209/397 |
| 1076962 | 4/1954 | France | 160/229 R |

*Primary Examiner*—Robert Halper
*Attorney, Agent, or Firm*—William A. Drucker

[57] ABSTRACT

A sieve screen module comprises a plurality of screen elements whose opposed edges contain complementary formations interlocked by an elongate member fixedly secured in the formation by a settable material. A number of modules may be assembled by passing a rod thru the elongate member.

5 Claims, 8 Drawing Figures

Figures 1, 2, 3:
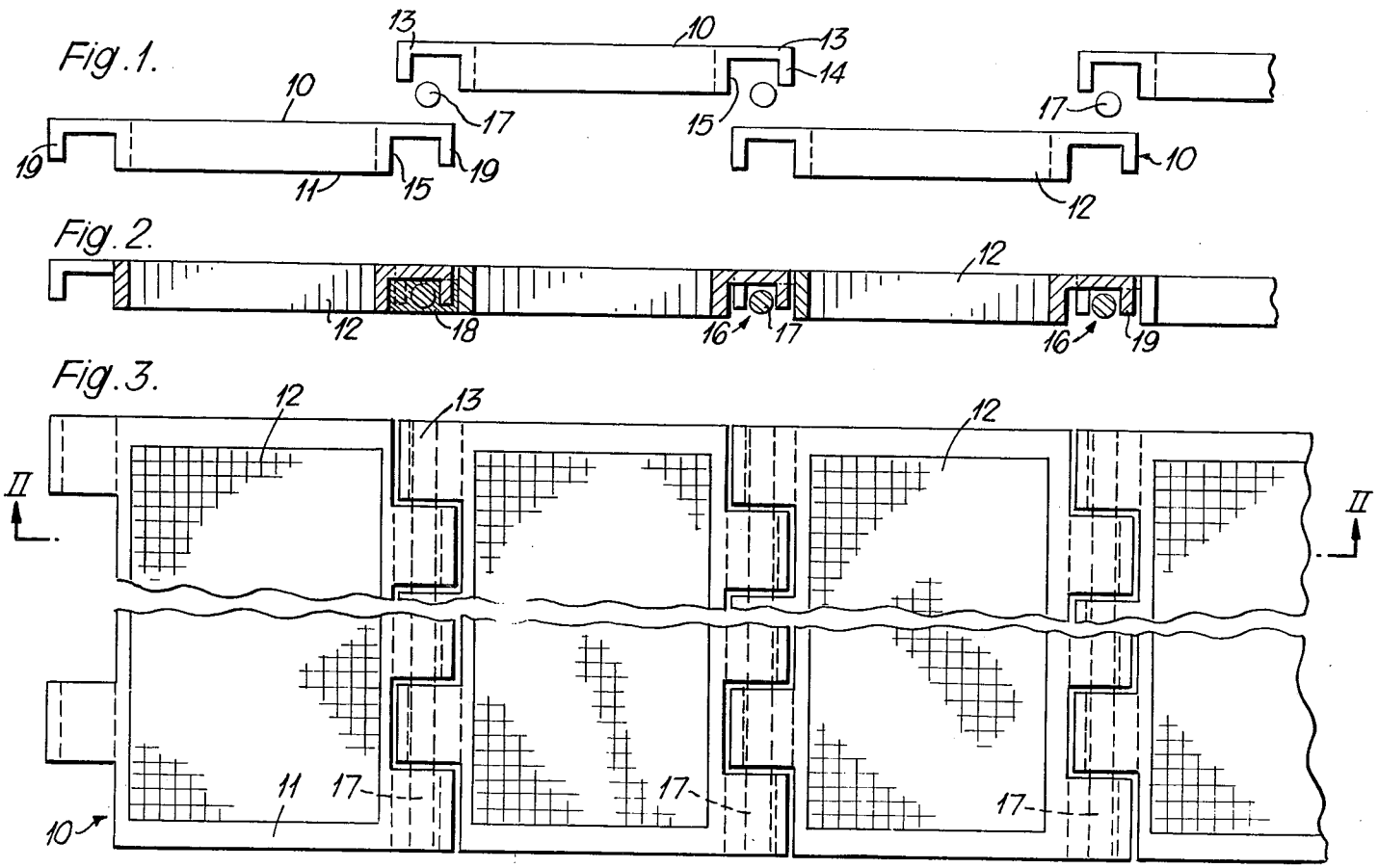

10
11
12
13
14
15
16
17
18
19
II

INTERLOCKING SCREEN ELEMENTS

This invention relates to screening, and in particular to sieve screens produced by connecting together a plurality of sieve elements. Such screens are used in screening machines for dewatering, grading and the like.

It is known to cast an individual sieve element in a standard size as a mesh of polymeric material having apertures of a required shape and size. The mesh is often reinforced by the incorporation of inelastic material during casting.

A plurality of such sieve elements are then bonded together to provide a sieve screen of desired overall dimensions which is then fitted over a support frame in the screening machine.

According to the present invention a method of making at least part of a sieve screen includes the step of interlocking a plurality of sieve elements with complementary formations of adjacent elements engaging and defining an open-sided channel receiving an elongate interlocking member, which member is then secured against relative lateral movement of the screen elements.

Preferably the elements are interlocked by a rigid member such as a rod, tube, wire or the like extending through or into the engaged formations.

According to another aspect of the invention a sieve screen part is made by the method of the first aspect and comprises a plurality of interlocked sieve elements with complementary formations of adjacent elements engaging and interlocked.

In preferred embodiments the formations are adapted to engage with those of an adjacent sieve element and define the channel to receive an interlocking member and be filled with settable material to provide a substantially smooth continuous surface for the joint between the elements.

The interlocking prevents relative lateral movement of the elements i.e. in the plane of the sieve screen and, each sieve element includes an apertured body portion, the complementary formations comprising extension pieces from the edges thereof.

In one embodiment of the invention, the sieve elements include apertured body portions, the complementary formations comprising extension pieces at the edges to be engaged and of less thickness than the elements. The extensions serve to space the sieve elements to provide the channel therebetween, and may further be provided with means, such as depending limbs, for engaging the interlocking member to provide a mechanical interlocking effect.

In one method of embodying the invention the interlocking member is secured by introducing into the cavity a settable material e.g. liquid polymeric material or other adhesive. This material may fill the cavity and may also enclose substantially the whole length of the member, but leaving the ends accessible.

When the liquid polymeric material sets the sieve elements are secured to each other and/or the interlocking member by mechanical interlocking and/or adhesion.

When a desired number of sieve elements have been joined together in this way to produce a sieve screen part or module of a desired length, a sieve screen, flat or curved, of a desired width may be provided by joining a plurality of parts or modules by a rod or rods of metal or the like which extends through corresponding tubes in adjacent modules. The rods may be provided with means for securing them to the structure of a screening machine.

Stiffening members may be provided between adjacent modules, preferably in the form of strips having slots spaced at intervals corresponding to the rods. The strips are fitted onto the rods between adjacent sieve modules after the modules have been located on the rods.

The modules may be clamped together by fixing bars, similar to the stiffeners, extending along the ends of the rods and secured thereto, for example by screws or welding.

Where a sieve screen is to be tensioned when in position in the screening machine, a filamentary member such as a flexible cord or the like may be used instead of a rod. The flexible cord need not be secured to the fixing bar of the end module but would be provided at its ends with means for securing it to conventional tensioning and/or clamping means of the screening machine.

Other aspects of the invention comprise a sieve screen at least part of which is made by one of the foregoing methods, sieve screen elements for use in the foregoing method and a screening machine including such a sieve screen.

Embodiments to the invention will now be described by way of example and with reference to the accompanying schematic drawings, in which:

FIG. 1 shows an exploded view of a portion of a sieve module, in which a plurality of sieve slements are to be joined together with a tube extending between juxtaposed edges of adjacent elements.

Figure 4:
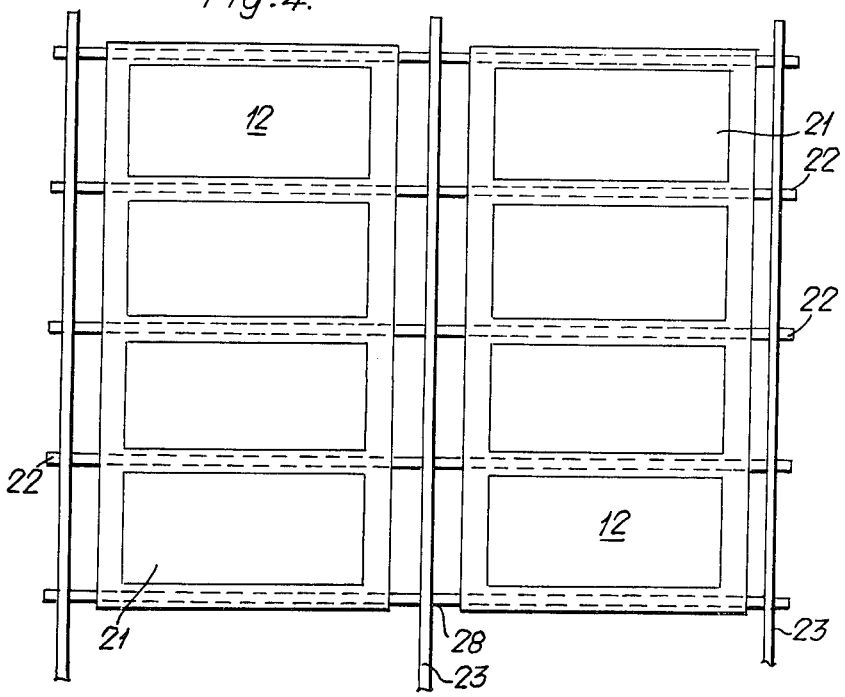
Figure 5:
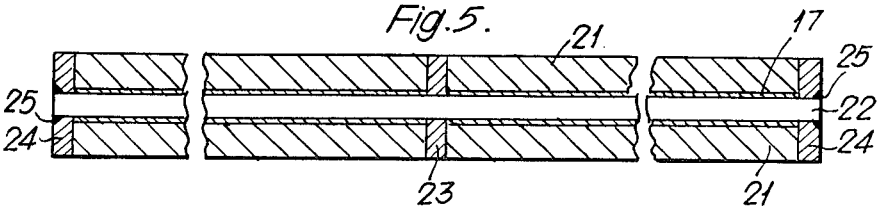
Figure 7:
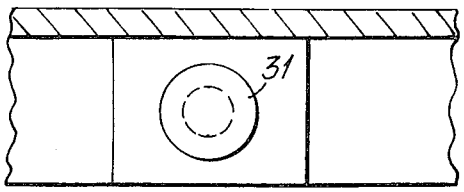
Figure 6:
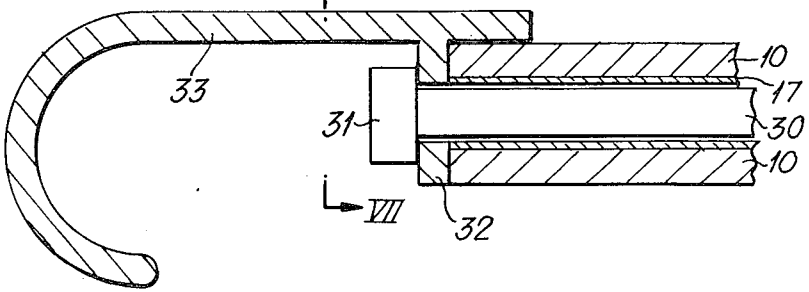
Figure 8:
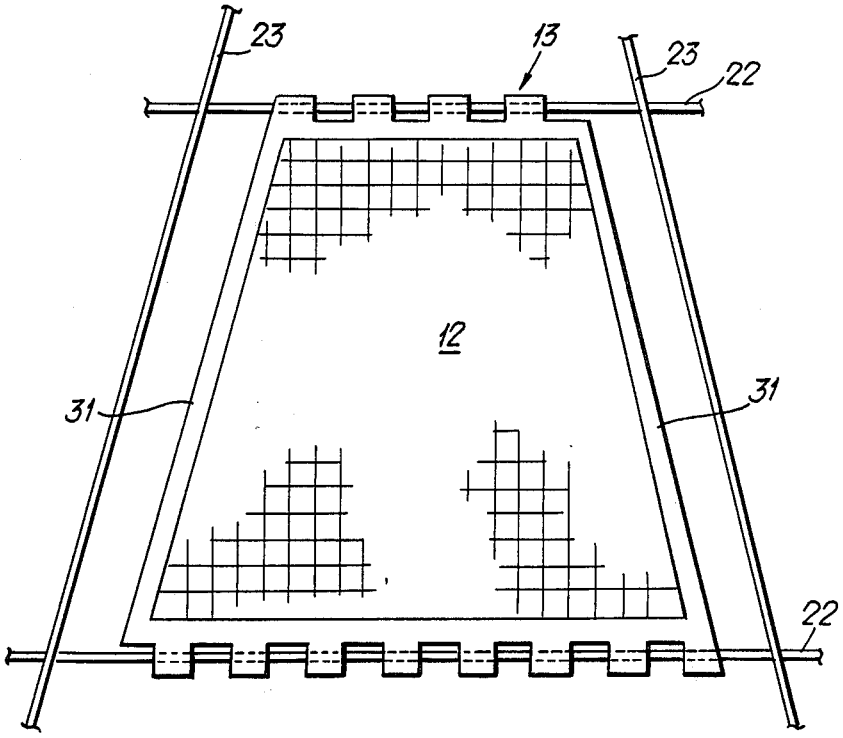

FIG. 2 shows a sectional side elevation of the screen of FIG. 1, with the element in position for securing of the tube, FIG. 3 shows a plan view of the sieve of FIGS. 1 and 2, FIG. 4 is an exploded view of a portion of a sieve screen which comprises modules of the kind shown in FIG. 1 joined together by rods, FIG. 5 is a sectional side view of the sieve screen of FIG. 4, FIG. 6 shows the manner in which a flexible cord extending through the tube of a screen module is adapted for fastening to tensioning means in the screening machine, FIG. 7 shows an end elevation corresponding to FIG. 6, FIG. 8 shows an alternative form of element.

Where corresponding parts are shown in different Figures they are given the same reference numeral.

Referring to FIGS. 1, 2 and 3, sieve elements 10 include rectangular parallelepiped body portions 11 which have apertures therethrough to provide in each a mesh 12. Opposed edges of the body portions have surface extension pieces 13, castellated as shown in FIG. 3. The castellations are dimensioned so that when two similar elements are juxtaposed the extension pieces interlace to provide a substantially smooth continuous surface for the joint between them. The extension pieces are of lesser thickness than the body portion and serve to space the juxtaposed elements to leave a channel 16 therebetween (FIG. 2).

When making a sieve-screen module, a plurality of sieve elements are juxtaposed with their extension pieces interlaced, a tube 17 is laid in the channel to extend across the extension pieces, and the channel filled with liquid polymer 18. When the polymer sets the elements are bonded securely together.

Mechanical interlocking of the elements with the tube is provided by limbs 19 which depend from, and are integral with, respective ends of extension pieces 13 of the sieve elements.

FIGS. 4 and 5 show sieve screen modules 21, produced as described above, arranged for assembly together to form a sieve screen. Metal rods 22 extend through corresponding tubes of adjacent modules 21. Stiffeners 23, in the form of elongate strips of rectangular cross-section are located between the modules, the rods passing through slots 28 in the strips.

When the desired number of modules have been assembled onto the rods, fixing bars 24, similar to the stiffeners, are positioned across the edges of the modules adjacent to the ends of the rods, and are welded to the rods as indicated at 25. Other means of securing the fixing bars to the rods could be used, for example screws.

A sieve screen made in the aforesaid way may be flat or curved, and the tubes may be rigid or flexible.

An advantage of the above embodiments is that the complementary formations of adjacent elements provide for a secure, substantially aperture-free joint between the screen elements whilst wasting little of the useful sieve area of the screen.

Where a sieve screen is to be tensioned, a flexible cord 30 may replace each rod 22. A modified fixing bar is used in combination with the flexible cord and is illustrated in FIGS. 6 and 7. The flexible cord 30 extends through a flexible tube 17 embedded in the joint between sieve elements 10 and has an enlarged head portion 31. The fixing bar includes an apertured plate portion 32 through which the cord extends and which is clamped by the enlarged head portion 31 against the edges of the sieve elements 10. Integral with the plate 32 and extending away from the plate and sieve element is a hooked portion 33 of the fixing bar. This hooked portion is adapted to engage with the conventional clamping and tensioning means provided in the screening machine.

An advantage of a sieve screen being tensioned in this way is that elongation or other deformation of the sieve apertures is avoided since the tensioning force is not applied directly across the sieve elements.

It will be appreciated that the invention affords practical advantage in the construction and/or maintenance of sieve screens. During construction, virtually any desired sieve dimension can be obtained by suitable choice of modules and elements. During maintenance, individual modules or elements can be replaced quickly and easily by removing the fixing bars, dissembling the modules from the rods, substituting modules as required, and reassembling as per the foregoing description.

The sieve elements described could be metal, synthetic plastics or a combination of both. For example, synthetic plastics material could be formed around a metal grid-like skeletal support structure. Extension pieces and outer covering of the grid would then be of synthetic plastics material having a long life compared to, say, mild steel, from which the grid could be made. Alternatively, the extension pieces could be of metal with a synthetic plastics material sieve insert.

A suitable synthetic plastics material having good wear characteristics in polyurethane.

The individual sieve elements may conveniently be injection moulded.

In the foregoing description the individual sieve elements 10 are of a flat rectangular shape, but embodiments of the invention comprehend other shapes, for example tapered and/or curved, especially where the screen is for use as a centrifuge basket.

FIG. 8 shows, in plan, an element 10 having castellated formations 13 engaging interlocking members 22 in the usual way, but having its other sides 31 converging, there being a correspondingly lesser number of castellations at one end of the element than at the other.

It will be appreciated that where the element is both tapered and curved, a plurality of elements connected together will form a conical screen.

We claim:

1. A sieve screen module comprising:

(i) a plurality of interlocked sieve elements, each sieve element having a rectangular parallelpiped body formed with through apertures to provide a mesh, opposed edges of said body having castellated formations arranged and dimensioned so as to be interdigitated with the complementary formations of the juxtaposed elements to provide a smooth joint, the underside of said formations being grooved to form together a continuous channel, (ii) an elongate member extending along within said channel and a settable material contained in said channel which adheres to the elongate member and channel walls for locking said sieve elements together.

2. A sieve screen module, as claimed in claim 1 wherein said elongate member is a tube.

3. A sieve screen comprising:

(i) a plurality of sieve screen modules as claimed in claim 1, and (ii) coupling members extending through said elongate members connecting adjacent sieve elements to join said modules.

4. A sieve screen, as claimed in claim 3, wherein each said coupling member comprises a rod.

5. A sieve screen, as claimed in claim 4, including a stiffening member extending between adjacent sieve screen modules and through which each said rod extends.

* * * * *